US009002225B2

(12) United States Patent
Oshima et al.

(10) Patent No.: US 9,002,225 B2
(45) Date of Patent: Apr. 7, 2015

(54) IMAGE FORMING APPARATUS WITH DEVELOPER FEEDING CONTROL

(71) Applicant: Canon Kabushiki Kaisha, Tokyo (JP)

(72) Inventors: Nobuo Oshima, Kawasaki (JP); Masahiro Yoshida, Tokyo (JP); Koichiro Takashima, Fujisawa (JP); Kohei Matsuda, Fujisawa (JP); Kuniaki Tamagaki, Kawasaki (JP); Takashi Mukai, Kawasaki (JP); Jun Miura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 13/684,791

(22) Filed: Nov. 26, 2012

(65) Prior Publication Data

US 2013/0148992 A1 Jun. 13, 2013

(30) Foreign Application Priority Data

Nov. 30, 2011 (JP) ..... 2011-261209

(51) Int. Cl.
*G03G 15/08* (2006.01)
*G03G 15/00* (2006.01)

(52) U.S. Cl.
CPC ..... *G03G 15/0877* (2013.01); *G03G 15/0808* (2013.01); *G03G 15/50* (2013.01)

(58) Field of Classification Search
USPC ..... 399/53, 27
See application file for complete search history.

(56) References Cited

U.S. PATENT DOCUMENTS

| | | | | |
|---|---|---|---|---|
| 7,890,007 | B2 | 2/2011 | Tsuchiya | |
| 7,912,390 | B2 * | 3/2011 | Mitsui | 399/61 |
| 8,116,668 | B2 | 2/2012 | Koyanagi et al. | |
| 2007/0183799 | A1 | 8/2007 | Tsuchiya | |
| 2009/0269094 | A1 * | 10/2009 | Mitsui | 399/53 |
| 2011/0085807 | A1 * | 4/2011 | Kawamura | 399/27 |
| 2011/0085808 | A1 * | 4/2011 | Hirata | 399/27 |
| 2011/0135331 | A1 | 6/2011 | Mitsui | |
| 2012/0183311 | A1 * | 7/2012 | Hasegawa | 399/27 |

FOREIGN PATENT DOCUMENTS

| | | | |
|---|---|---|---|
| JP | 5-158338 | A | 6/1993 |
| JP | 2006-227535 | A | 8/2006 |
| JP | 2007-212752 | A | 8/2007 |
| JP | 2011-118239 | A | 6/2011 |

* cited by examiner

*Primary Examiner* — G. M. Hyder
(74) *Attorney, Agent, or Firm* — Fitzpatrick, Cella, Harper & Scinto

(57) ABSTRACT

An image forming apparatus capable of forming an image includes an image bearing member on which an electrostatic latent image is to be formed, a developer carrying member for carrying a developer to visualize the electrostatic latent image, and a developer feeding member, having a foam layer at its surface, for feeding the developer to the developer carrying member by being rotated in contact with the developer carrying member. In addition, a controller is capable of executing an operation in a first mode in which the developer feeding member is rotated for a first time and then the electrostatic latent image is visualized at a first speed by the developer carrying member and an operation in a second mode in which the developer feeding member is rotated for a second time longer than the first time and then the electrostatic latent image is visualized at a second speed slower than the first speed by the developer carrying member.

4 Claims, 13 Drawing Sheets

(a)

| MODE | PRCSS SPD | RTTN SPD | CONTENT | RTTN (TIMES) | RTTN (TIMES) |
|---|---|---|---|---|---|
| NORMAL | 50mm/sec | 64mm/sec | $\alpha 1 = 8g$ | $\beta 1 = 21$ | – |
| LOW-SPD | 25mm/sec | 32mm/sec | $\alpha 2 = 9.3g$ | $\beta 2 = 40$ | $\gamma 2 = 10$ |

(b)

| MODE | PRE-RTTN (TIMES) | TOTAL PRE-RTTN | NORMAL PRE-RTTN | EXTNTN | SOLID BLACK |
|---|---|---|---|---|---|
| NORMAL | 22 | 15sec | 15sec | – | ○ |
| LOW-SPD (i) | 22 | 30sec | 30sec | 0sec | △ |
| LOW-SPD (ii) | 30 | 41sec | 30sec | 11sec | ○ |

Fig. 6

(a)

| MODE | PRCSS SPD | RTTN SPD | NORMAL PRE-RTTN | CONTENT | RTTN (TIMES) | RTTN (TIMES) |
|---|---|---|---|---|---|---|
| NORMAL | 80mm/sec | 102mm/sec | 9.4sec | a1=7.5g | b1=15 | – |
| LOW-SPD (1) | 50mm/sec | 64mm/sec | 15sec | a2=8g | b2=21 | c2=5 |
| LOW-SPD (2) | 25mm/sec | 32mm/sec | 30sec | a3=9.3g | B3=40 | c3=10 |

(b)

| MODE | PRE-RTTN (TIMES) | TOTAL PRE-RTTN | NORMAL PRE-RTTN | EXTNTN | SOLID BLACK |
|---|---|---|---|---|---|
| NORMAL | 4 | 9.4sec | 9.4sec | – | ○ |
| NRML → LOW-SPD (1) | 22 | 15sec | 15sec | 0sec | ○ |
| NRML → LOW-SPD (2) | 35 | 48sec | 30sec | 18sec | ○ |
| COMP. EMB. (NRML → LOW-SPD (2)) | 22 | 30sec | 30sec | 0sec | △ |

Fig. 9

(a)

| MODE | PRE-RTTN (TIMES) | TOTAL PRE-RTTN | NORMAL PRE-RTTN | EXTNTN | SOLID BLACK |
|---|---|---|---|---|---|
| NORMAL | 4 | 9.4sec | 9.4sec | – | – |
| NRML→LOW-SPD (2) | 35 | 48sec | 30sec | 18sec | c2=5, d2=8 |

(b)

| MODE | PRE-RTTN (TIMES) | TOTAL PRE-RTTN | NORMAL PRE-RTTN | EXTNTN | SOLID BLACK |
|---|---|---|---|---|---|
| NORMAL | – | 9.4sec | 9.4sec | – | ○ |
| NRML→ LOW-SPD (2) | 35 | 48sec | 30sec | 18sec | ○ |
| NRML→ LOW-SPD (1) → LOW-SPD (2) | 35(3+32) | 46sec | 30sec | 16sec | ○ |

Fig. 13

IMAGE FORMING APPARATUS WITH DEVELOPER FEEDING CONTROL

FIELD OF THE INVENTION AND RELATED ART

The present invention relates to an image forming apparatus, such as a copying machine or a laser printer, using an electrophotographic process and particularly relates to the image forming apparatus operable in a low-speed mode employed in the case where thick paper or coated paper is subjected to printing.

In a conventional image forming apparatus using the electrophotographic process, a developing device for accommodating a developer for visualizing an electrostatic latent image formed on a photosensitive drum is provided. In the developing device, in general, a developing roller for carrying a toner, a developing blade for regulating and electrically charging the toner, and a supplying roller for supplying the toner onto the developing roller are provided.

The supplying roller is formed with a foam member in general and contacts and enters the developing roller for developing the electrostatic latent image with the toner. This is because the toner is supplied to the developing roller and a constant toner state on the developing roller is always maintained by removing the toner, remaining on the developing roller, which is not used for the development.

However, the supplying roller contacts the developing roller and therefore there was a problem such that the foam member is deformed at a contact position by long-term storage. For that reason, a toner supply amount and a toner remaining force are changed at a deformation position, so that a charge amount and coating amount of the toner on the developing roller are changed.

In this case, when the toner amount is decreased, an image defect such that a white dropout portion is generated on a solid black image with a period of the supplying roller was generated in some cases. This is a phenomenon generated because the supplying roller cannot contain the toner while being deformed and therefore it becomes difficult to supply the toner to the developing roller at the deformation position.

Generally, the phenomenon is generated due to the deformation of the foam member by maintaining the foam member in the contact state in the long-term storage or the like. For this reason, a degree of the deformation of the foam member has been alleviated by spacing the foam member from the developing roller during a period other than that for image formation as described in Japanese Laid-Open Patent Application (JP-A) Hei 05-158338 or by increasing the number of rotations of the foam member before the image formation as described in JP-A 2006-227535.

Further, the image forming apparatus is generally operable in some different print modes. This is because printing operations for different purposes can be executed and an overall efficient print mode is selectable, and therefore the print modes include a normal (speed) mode and a low-speed mode.

The normal mode is used in the case where a normal printing operation is performed. Further, the low-speed mode is used in the case where as a recording material, an OHT (Overhead Transparency) sheet (a transparent sheet used for an OHP (Overhead Projector) different in transfer condition and fixing condition from those in the normal mode is used. Alternatively, it is assumed that the low-speed mode is used in the case where thick paper is used. For that reason, a print speed is made lower than that in the normal mode, so that the toner (image) is easily fixed and thus glossiness and permeability (transparency) are improved.

However, even in the case where there is no particular problem such as the generation of the image defect with the supplying roller period in the operation in the normal mode, when the print mode is switched from the normal mode to the low-speed mode, the image defect was generated with the supplying roller period in some cases. This image defect was a defective image similar to a white dropout image generated, with the supplying roller period by improper supply of the toner, in the case where the toner amount is small at a later stage of continuous image formation in the operation in the normal mode.

It has been found that the image defect is conspicuously generated particularly at a portion where the supplying roller contacts the developing roller and is deformed. The image defect differs from the white dropout image generated at the later stage of the continuous image formation and is generated also at an initial stage of the continuous image formation. In this case, a remaining toner amount is sufficient and a deformation amount of the supplying roller is small and therefore the image defect was a phenomenon peculiar to the case where the print mode is switched from the normal mode to the low-speed mode.

As a result of study by the present inventors, it has been found that this phenomenon is caused by a change in amount of the toner incorporated in the supplying roller depending on the process speed. In the case where the process speed is fast, i.e., in the case where the rotational speed is fast, a toner content of the supplying roller becomes small.

On the other hand, in the case where the process speed is slow, i.e., in the case where the rotational speed is slow, the toner content became large.

Therefore, in the case where the print mode is switched from the normal mode to the low-speed mode, the toner content of the supplying roller is changed. As a result, in a process in which the toner is incorporated into the supplying roller immediately after the mode switching, a supply amount of the toner onto the developing roller is decreased. As a result, it has been found that the image defect is generated. The image defect was a problem conspicuously generated particularly at the contact and deformation position of the supplying roller.

SUMMARY OF THE INVENTION

The present invention has solved the above-described problem. A principal object of the present invention is to provide an image forming apparatus for placing a developer feeding member in a state in which a developer is sufficiently incorporated into the developer feeding member in the case where a print mode is switched from a mode in which a print speed is fast to a mode in which the print speed is slow.

According to an aspect of the present invention, there is provided an image forming apparatus capable of forming an image at a plurality of image forming speeds, comprising: an image bearing member on which an electrostatic latent image is to be formed; a developer carrying member for carrying a developer to visualize the electrostatic latent image; a developer feeding member, having a foam layer at its surface, for feeding the developer to the developer carrying member by being rotated at a speed corresponding to each of the image forming speeds in contact with the developer carrying member; and a controller for rotating, before development, the developer feeding member for a predetermined time corresponding to the image forming speed, wherein the controller extends the predetermined time when an image forming mode is switched from a first mode in which image formation is effected at a first image forming speed to a second mode in which the image formation is effected at a second image forming speed slower than the first image forming speed.

These and other objects, features and advantages of the present invention will become more apparent upon a consideration of the following description of the preferred embodiments of the present invention taken in conjunction with the accompanying drawings.

Figure 4:
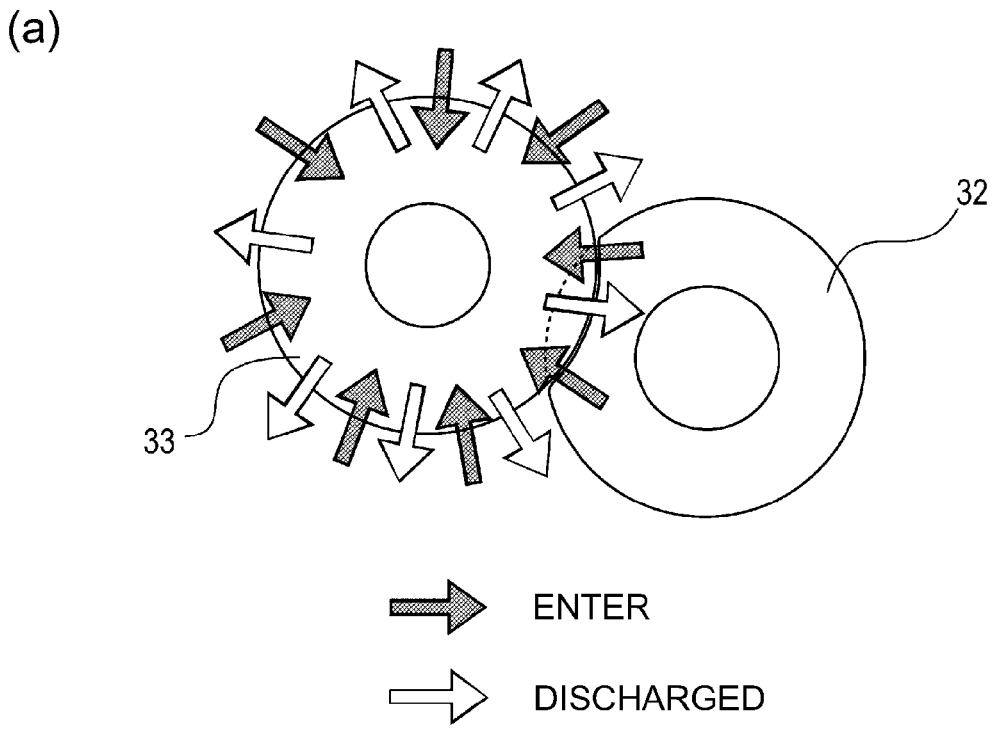
Figure 4:
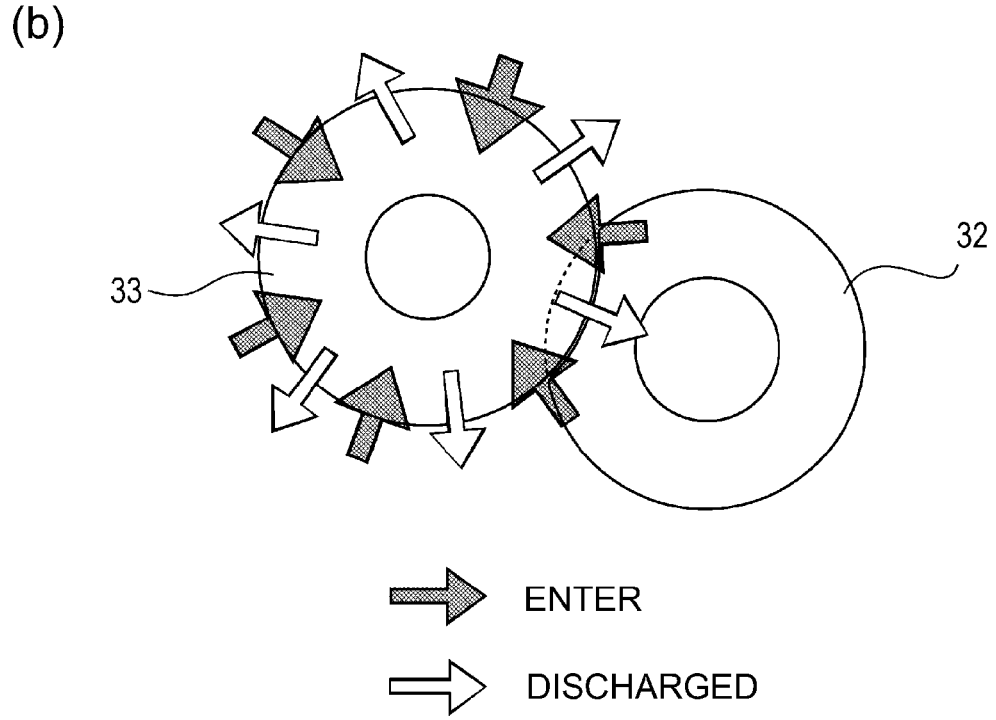

Part (a) of FIG. 4 is a schematic view for illustrating a state in which a toner absorbing amount and a toner discharging amount of the developer feeding member is balanced in First Embodiment. Part (b) of FIG. 4 is a schematic view for illustrating a state in which a print mode is switched from a normal mode to a low-speed mode, the developer feeding member starts toner absorption to destroy the balance between the toner absorbing amount and the toner discharging amount in the developer feeding member and the toner discharging amount is decreased and thus a toner supply amount to a developer carrying member is decreased.

Figure 5:
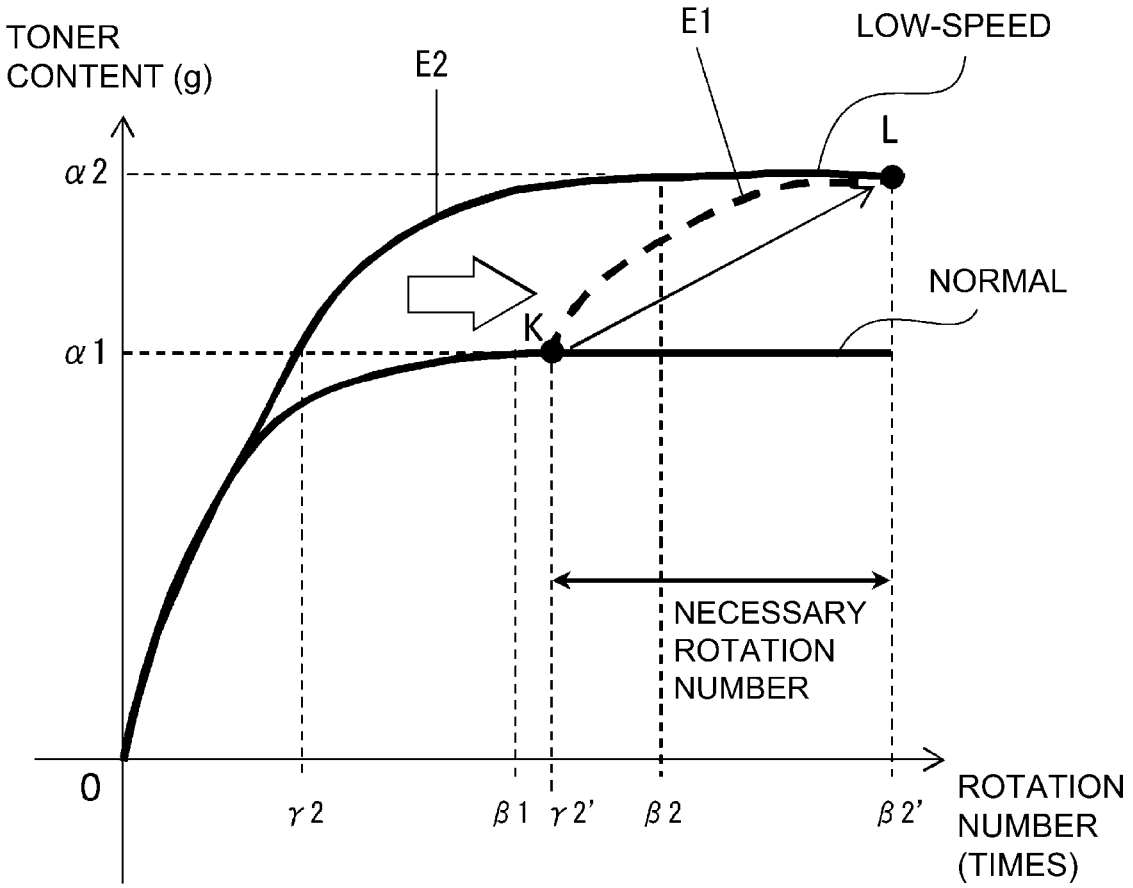

FIG. 5 is a graph, showing the toner content of the developer feeding member with respect to the number of rotations of the developer feeding member during pre-rotation in First Embodiment, for illustrating a state the number of rotations of the developer feeding member necessary until the toner content having reached a toner content reaching point in the normal mode reaches a toner content reaching point in the low-speed mode is obtained.

Part (a) of FIG. 6 is a table, in First Embodiment, showing a process speed, a rotational speed of the developer feeding member during pre-rotation, the toner content of the developer feeding member at the rotational speed and the numbers of rotations of the developer feeding member necessary until the toner content reaches certain toner content reaching points in each of the normal mode and the low-speed mode. Part (b) of FIG. 6 is a table showing an image quality result in the case where the number of rotations of the developer feeding member during pre-rotation is increased when the print modes is switched from the normal mode to the low-speed mode.

Figure 7:
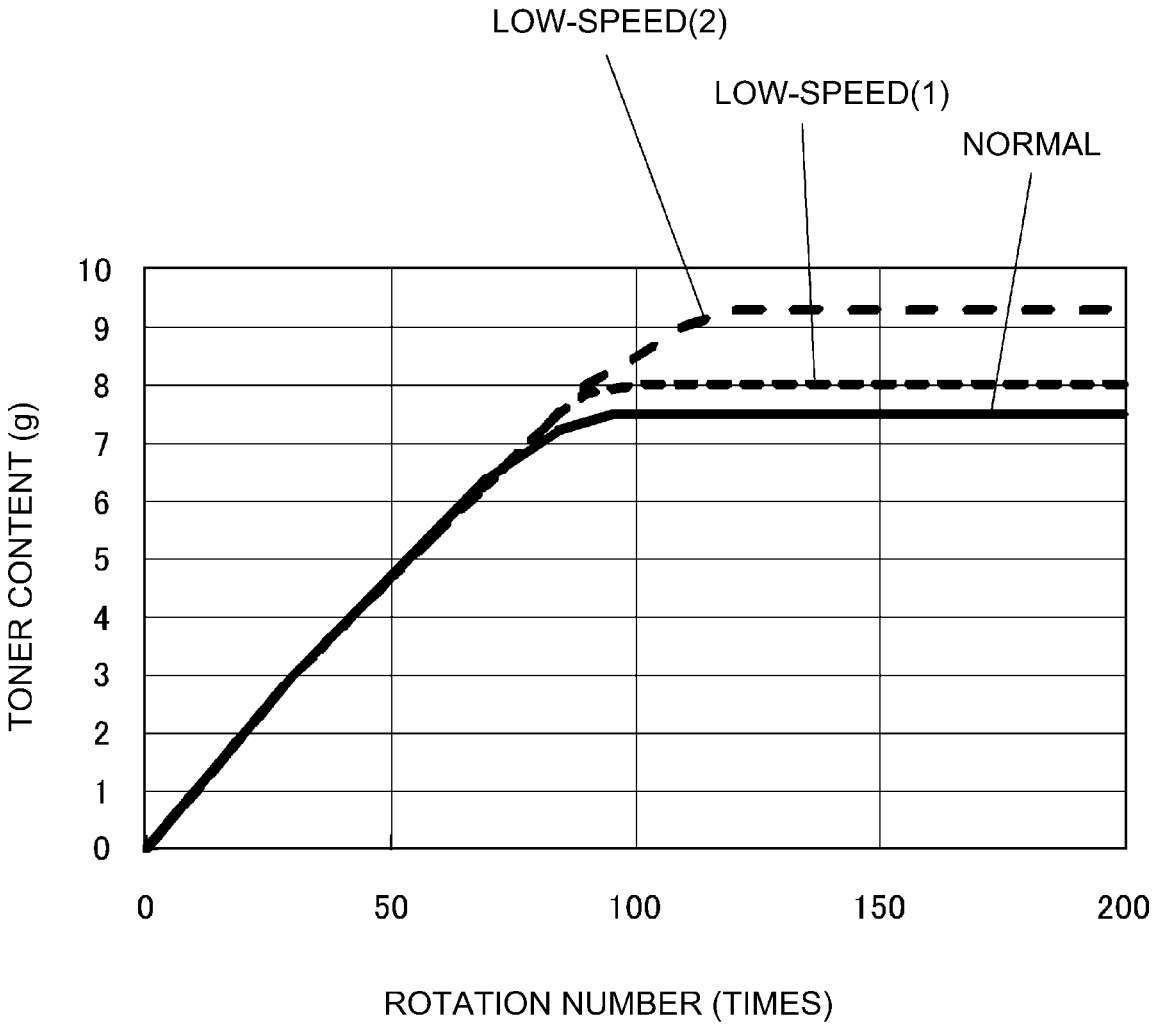

FIG. 7 is a graph showing the toner content of the developer feeding member with respect to the number of rotations of the developer feeding member during pre-rotation in each of the normal mode and low-speed modes (1) and (2) in the image forming apparatus according to the present invention in Second Embodiment.

Figure 8:
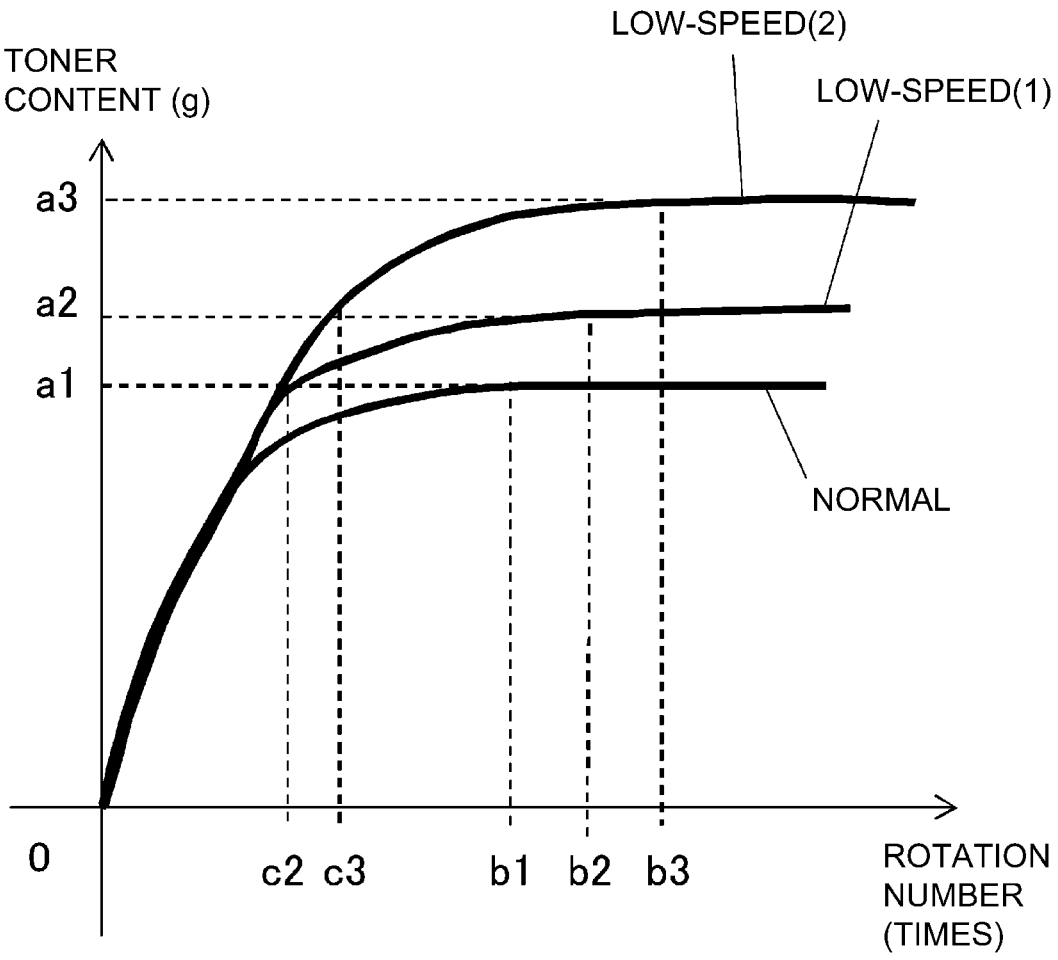

FIG. 8 is a graph, showing the toner content of the developer feeding member with respect to the number of rotations of the developer feeding member during pre-rotation in Second Embodiment, for illustrating the number of rotations of the developer feeding member necessary until the toner content having reached the toner content reaching point in the normal mode reaches the toner content reaching points of the low-speed modes (1) and (2) and for illustrating a state the number of rotations of the developer feeding member necessary until the toner content having reached the toner content reaching point in the low-speed mode (1) reaches a toner content reaching point in the low-speed mode (2) is obtained.

Part (a) of FIG. 9 is a table, in Second Embodiment, showing a process speed, a rotational speed of the developer feeding member during pre-rotation, the toner content of the developer feeding member at the rotational speed and the numbers of rotations of the developer feeding member necessary until the toner content reaches certain toner content reaching points in each of the normal mode and the low-speed modes (1) and (2). Part (b) of FIG. 9 is a table showing an image quality result in the cases where the number of rotations of the developer feeding member during pre-rotation is increased and is not increased when the print modes is switched from the normal mode to each of the low-speed modes (1) and (2).

Figure 10:
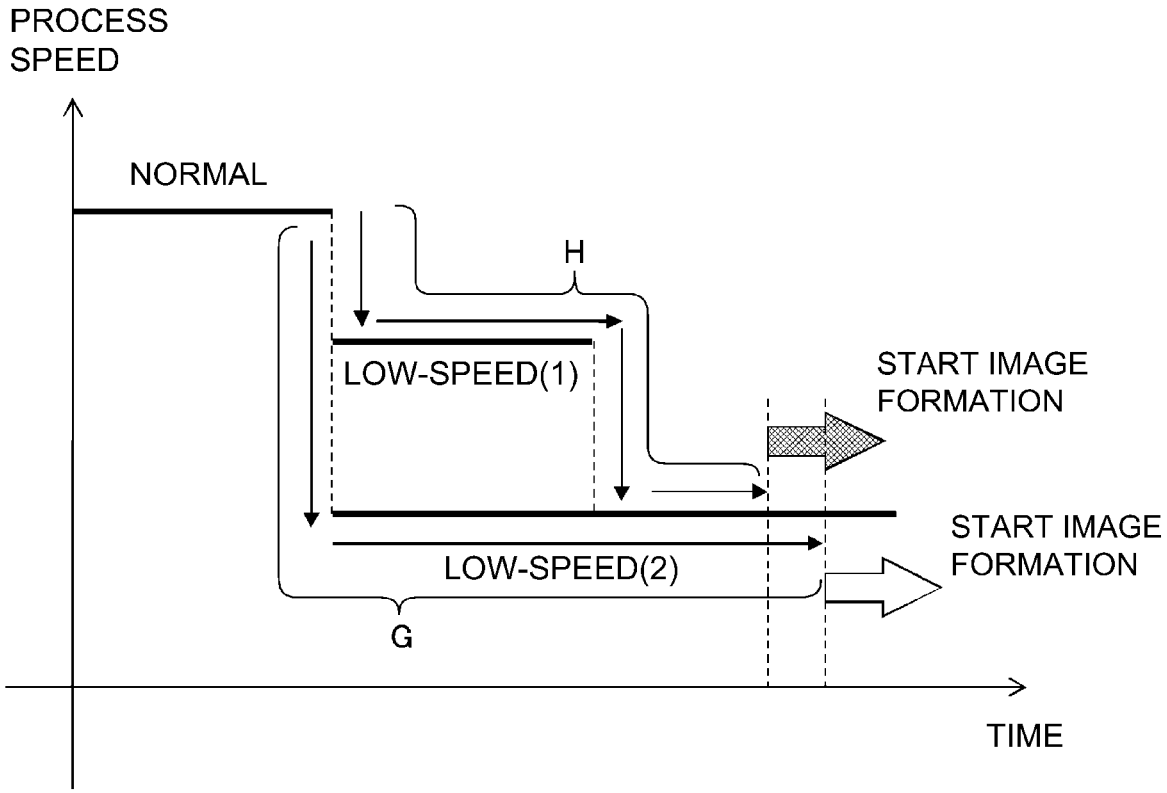

FIG. 10 is a schematic view for illustrating an operation for stepwisely controlling rotation of the developer feeding member during pre-rotation when the print mode is changed from the normal mode to the low-speed mode (2) by way of the low-speed mode (1) in the case where the print mode is switched from the normal mode to the low-speed mode (2) in the image forming apparatus according to the present invention in Third Embodiment.

Figure 11:
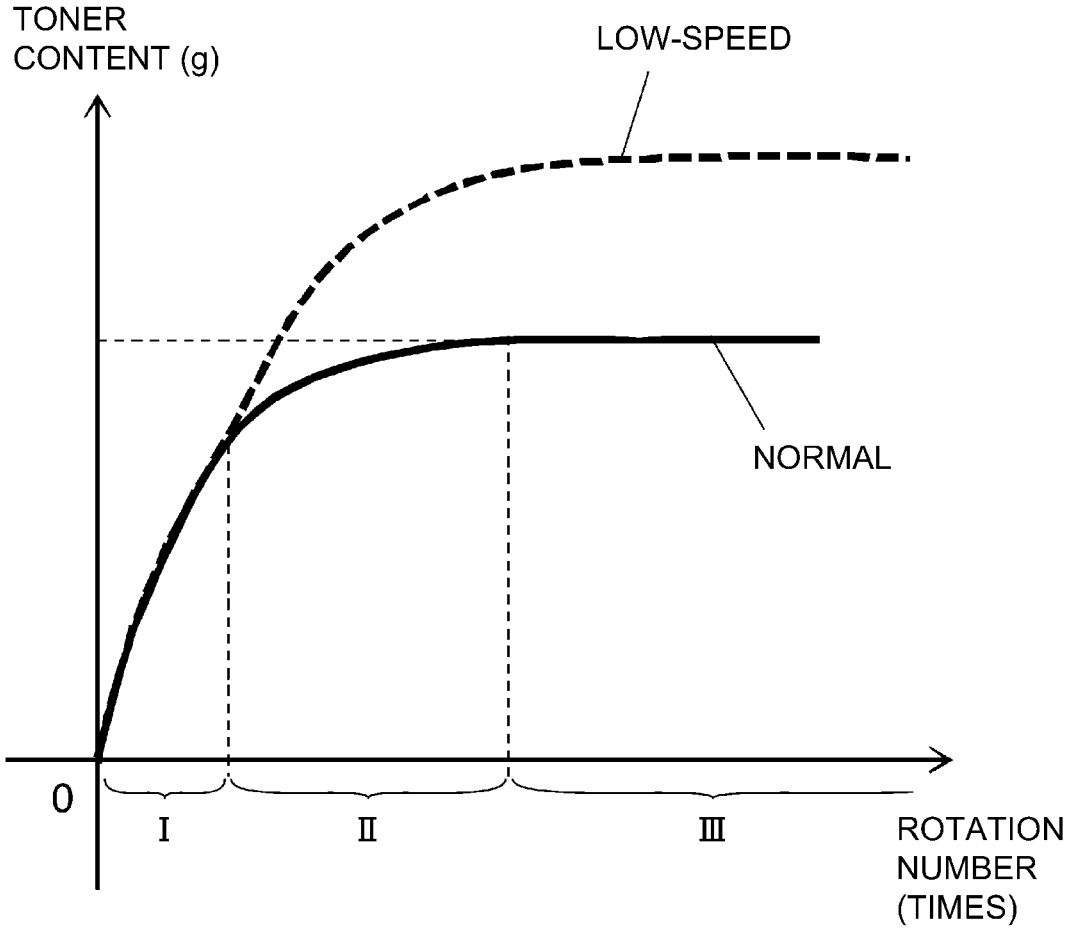

FIG. 11 is a graph showing the toner content of the developer feeding member with respect to the number of rotations of the developer feeding member during pre-rotation in Third Embodiment, for illustrating a state in which an increasing speed of the toner content with respect to the number of rotations of the developer feeding member in the normal mode is divided into three sections.

Figure 12:
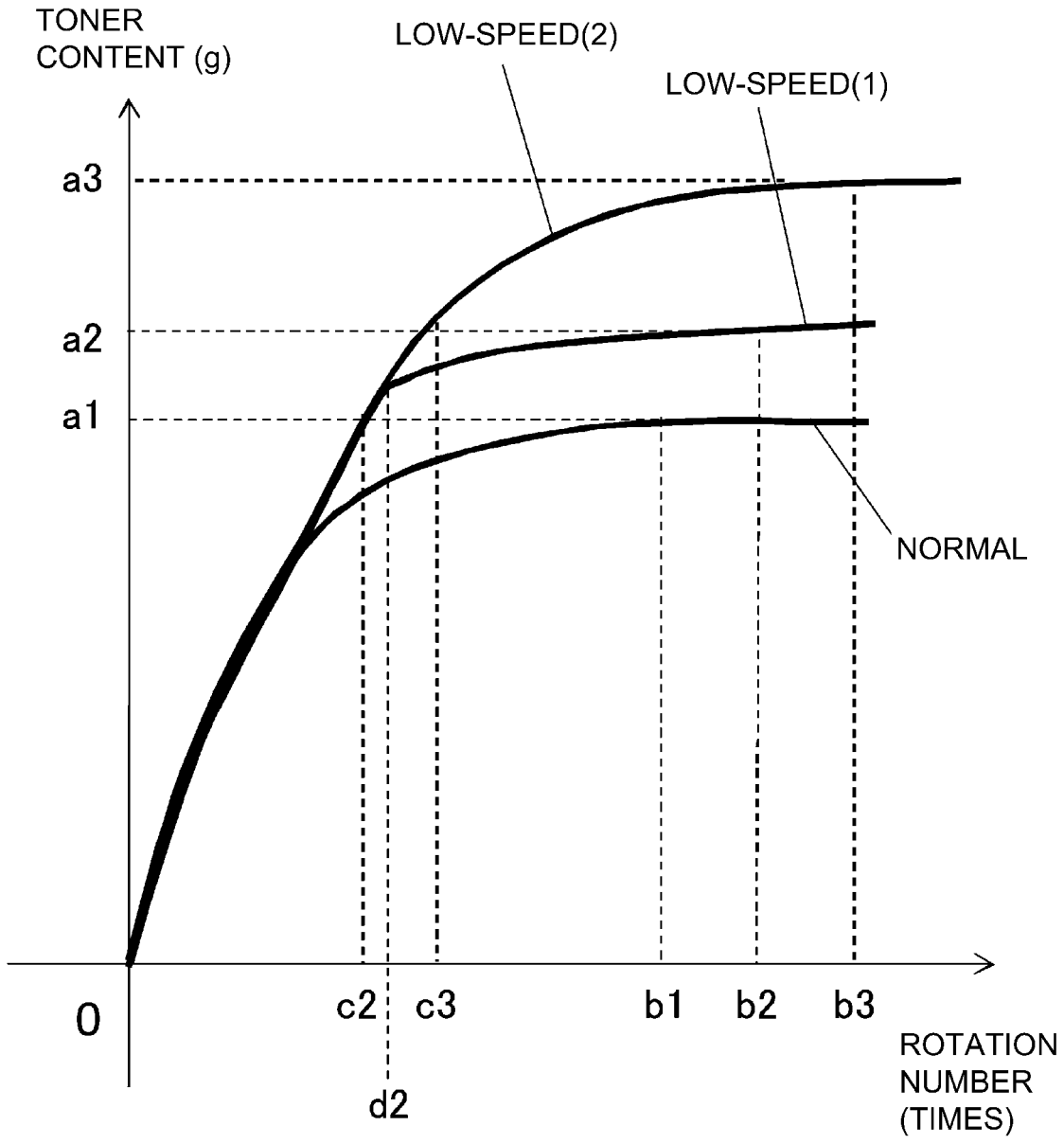

FIG. 12 is a graph showing the toner content of the developer feeding member with respect to the number of rotations of the developer feeding member during pre-rotation in Third Embodiment, for illustrating a state in which the rotation of the developer feeding member during pre-rotation in the low-speed mode (1) is continued until the number of rotations reaches the limit number of rotations up to which a toner content increasing speed in the low-speed mode (1) is the same as a toner content increasing speed in the low-speed mode (2).

Parts (a) and (b) of FIG. 13 are tables showing an image quality result in the cases where the number of rotations of the developer feeding member during pre-rotation is increased and is not increased when the print modes is switched from the normal mode to each of the low-speed modes (1) and (2) in Third Embodiment.

DESCRIPTION OF THE PREFERRED EMBODIMENTS

Hereinbelow, embodiments of the image forming apparatus according to the present invention will be specifically described with reference to the drawings. However, dimensions, materials, shapes, relative arrangements and the like of constituent elements described in the following embodiments are appropriately changed depending on constitutions or various conditions of devices (apparatuses) to which the present invention is applied, and the scope of the present invention is not limited thereto.

First Embodiment

First, a constitution of an image forming apparatus according to the present invention in First Embodiment will be described with reference to FIGS. 1 to 6.

In the constitution in this embodiment, an image forming apparatus 1 is operable in a plurality of print modes different in print speed. The image forming apparatus 1 includes a controller 16 as a control means for increasing the number of rotations of a supplying roller 33 as a developer feeding member during pre-rotation (during preparatory rotation) in an operation in a low-speed mode when a print mode (image forming mode) is switched from a normal (speed) mode in which the print speed is fast to the low-speed mode in which the print speed is slower than that in the normal mode.

<Image Forming Apparatus>

Figure 1:
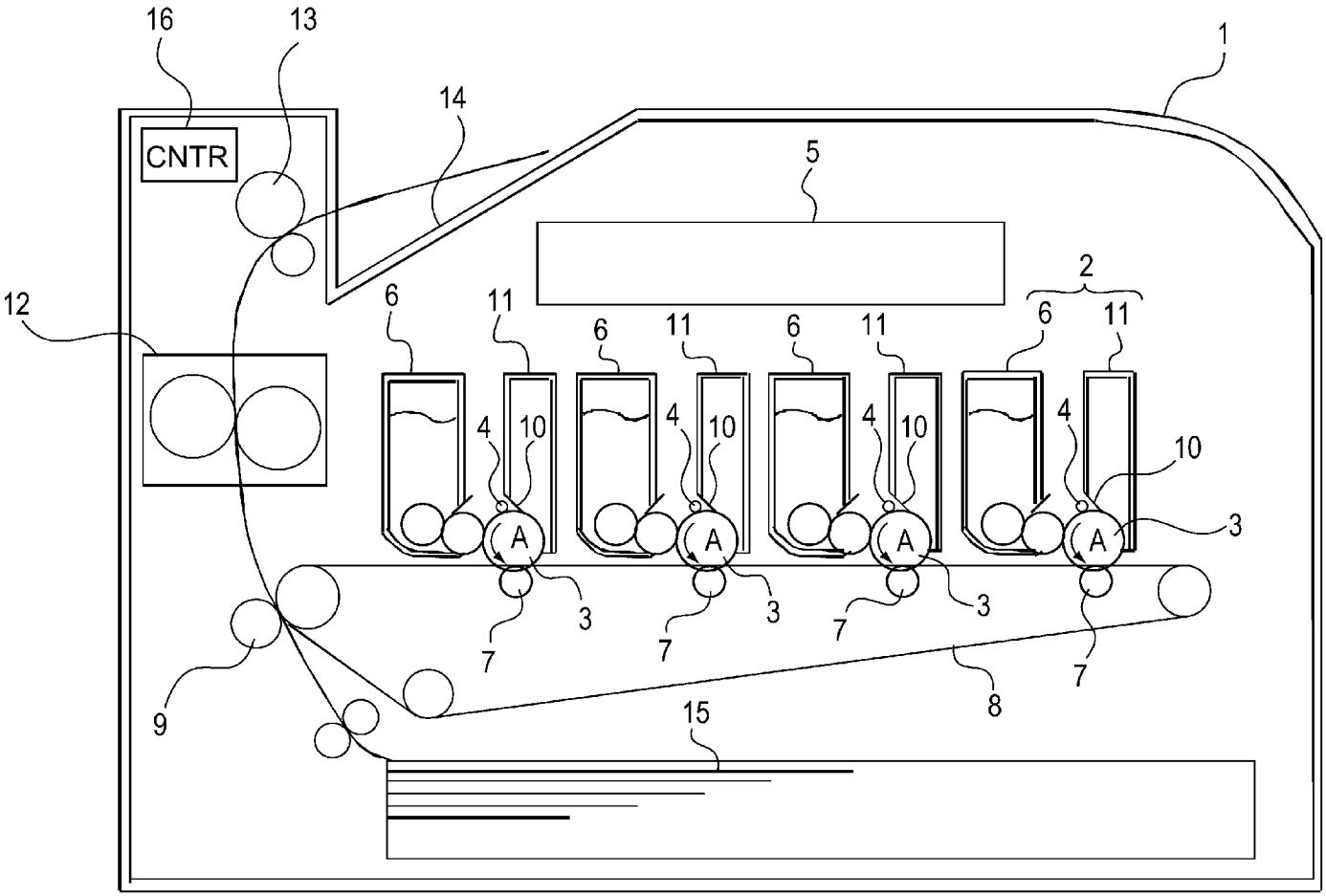
FIG. 1 is a sectional view for illustrating a structure of an image forming apparatus according to the present invention.

In FIG. 1, a process cartridge 2 is inserted into the image forming apparatus 1. A photosensitive drum 3 as an image bearing member on which an electrostatic latent image is to be formed has an outer diameter of 24 mm and is rotated in an arrow A direction in FIG. 1 at a process speed of 50 mm/sec. The surface of the photosensitive drum 3 is electrically charged uniformly by a charging roller 4 as a charging means schematic supplied with a voltage from an unshown voltage applying means. Thereafter, the surface of the photosensitive drum 3 is exposed to laser light from a laser optical device 5 as an exposure means, so that the electrostatic latent image is formed on the surface of the photosensitive drum 3.

The electrostatic latent image is developed by a developing device 6, as a developing means, of a non-magnetic one-component contact type, thus being visualized as a toner image with a toner 31 as a developer.

Figure 2:
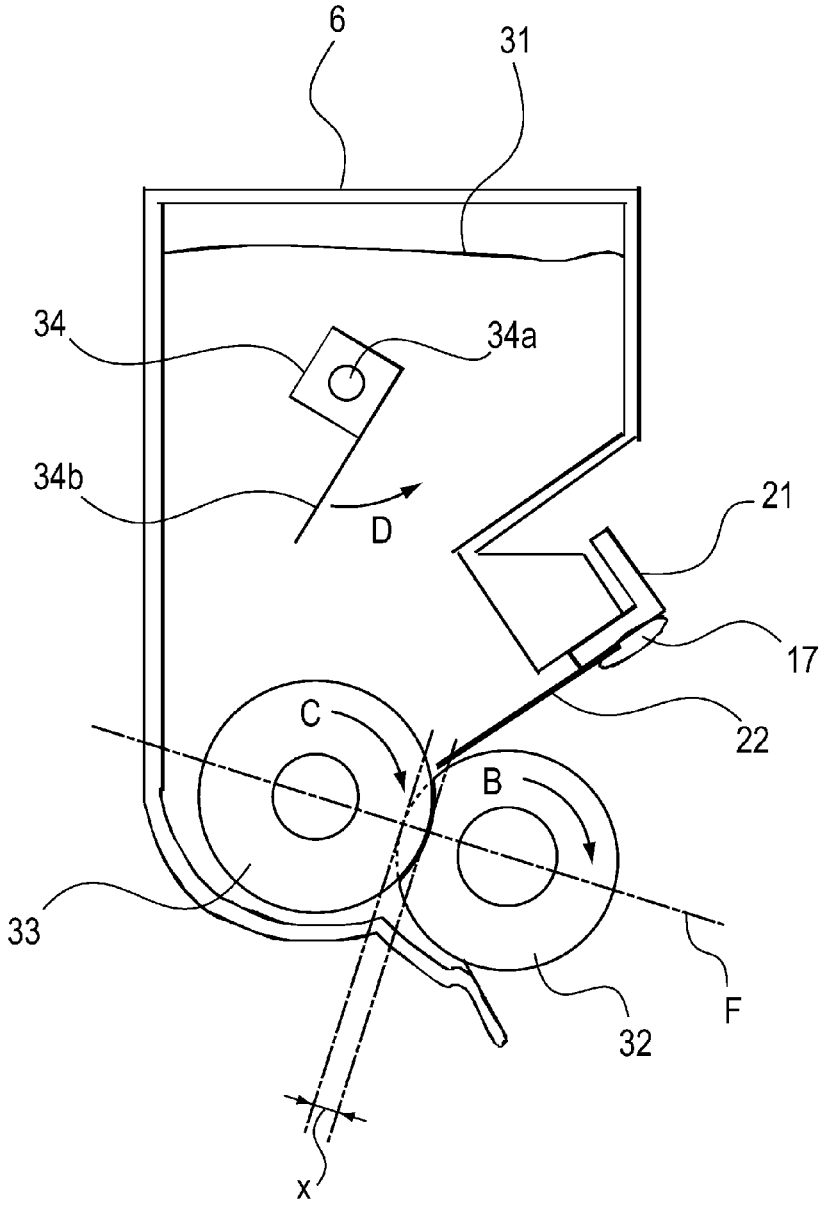
FIG. 2 is a sectional view for illustrating a structure of a developing device of the image forming apparatus according to the present invention.

The developing device 6 includes, as shown in FIG. 2, a developing roller 32 which is provided opposed to the photosensitive drum 3 and which is a developer carrying member for carrying the toner 31 as the developer for visualizing the electrostatic latent image formed on the surface of the photosensitive drum 3. Further, the developing device 6 includes a supplying roller 33 which is provided opposed to and in contact with the developing roller 32 and which is a developer feeding member for feeding (supplying) the toner 31 as the developer to the developing roller 32.

The visualized toner image on the photosensitive drum 3 in once transferred onto an intermediary transfer belt 8 by a primary transfer roller 7 as a primary transfer means and then is transferred onto a recording material 15 by a secondary transfer roller 9 as a secondary transfer means. A transfer residual toner remaining on the photosensitive drum 3 without being transferred is scraped off by a cleaning blade 10 as a cleaning means and is accommodated in a residual toner container 11. The cleaned photosensitive drum 3 repeats the above-described actions to effect image formation. On the other hand, the recording material 15 on which the toner image is transferred is, after the image of the toner 31 is permanently fixed thereon by a fixing device 12 as a fixing means, passed through a discharging roller 13 to be discharged to the outside of the image forming apparatus, thus being discharged onto a discharge tray 14.

<Developing Device>

A constitution of the developing device 6 will be described with reference to FIG. 2. In the developing device 6, a non-magnetic one-component toner 31 is accommodated. The toner 31 is formed of a base material of 6 mm in particle size (diameter), and various external additives such as silica for improving flowability are externally added into the base material. Further, to the developing device 6, a developing blade 22 is fixed via a supporting metal plate 21 by screws 17 at end portions the supporting metal plate 21, and the developing device 6 further includes the developing roller 32 as the developer carrying member and the supplying roller 33 as the developer feeding member.

The developing roller 32 is, in this embodiment, prepared by coating a surface layer formed of urethane resin on a base layer, formed of silicone rubber as an elastic member so as to provide an outer diameter of 12 mm, which is formed on a core metal of 6 mm in outer diameter. The developing roller 32 is rotated in an arrow B direction counterdirectional to the developing blade 22 in FIG. 2. A rotational speed of the developing roller 32 is 80 mm/sec, and the developing roller 32 is rotated with a peripheral speed ratio of 160% with respect to a peripheral speed of the photosensitive drum 3.

Further, the supplying roller 33 is prepared by forming a foam member (foam layer) of urethane foam on the surface of a core metal of 5 mm in outer diameter so as to provide an outer diameter of 14 mm. The urethane foam is formed so that the number of cells is 40 cells/inch (101.6 cells/cm=40×2.54 cells/inch). Further, the supplying roller 33 is rotated at 64 mm/sec in an arrow C direction counterdirectional to the developing roller 32 by an unshown drive transmission gear, and is rotated with a peripheral speed ratio of 80% with respect to the peripheral speed of the developing roller 32.

Further, the supplying roller 33 enters (penetrates) the developing roller 32 which is elastically deformable, and its penetration depth (entering amount) x is 1.2 mm. Here, the penetration depth x means an entering amount, of the supplying roller 33, which is a depth through which the supplying roller 33 enters a phantom shape of the developing roller 32 from a phantom circumferential point of the developing roller 32 on a rectilinear line F connecting the center of a phantom circle of the developing roller 32 and the center of (a circle of) the supplying roller 33.

The penetration depth x is an amount determined from a toner feeding (supplying) property of the supplying roller 33 and a toner removing property from the supplying roller 33. Further, a contact width between the developing roller 32 and the supplying roller 33 is 5.0 mm.

The supplying roller 33 generally has a function, in addition to the function of supplying the toner to the developing roller 32, such that a development history on the developing roller 32 is caused to disappear. For that reason, a sponge of urethane capable of sufficiently incorporating the toner in the supplying roller 33 and at the same time, capable of performing an operation for removing the residual toner from the developing roller 32 after the development.

The supplying roller 33 is contacted to the elastically deformable developing roller 32 with a predetermined penetration depth x. The supplying roller 33 is contacted to the developing roller 32 and thus is deformed at the contact portion. The supplying roller 33 creates a portion (absorbing portion), by the deformation, which escapes from the contact portion by the rotation thereof. At the absorbing portion, the cells forming the sponge are abruptly expanded from a compressed state and therefore a flow of the air into the supplying roller 33 is generated.

By this flow of the air into the supplying roller 33, the ambient toner particles are concurrently incorporated into the supplying roller 33. On the other hand, at a portion (discharging portion) where the circumferential surface of the supplying roller 33 enters the contact portion, the open cells are rather collapsed abruptly and therefore the toner particles incorporated in the cells are discharged and thus are supplied onto the opposing developing roller 32.

Further, after the toner particles are discharged, the circumferential surface of the supplying roller 33 enters the contact portion to remove the residual toner (particles) from the developing roller 32, thus eliminating the development history.

The supplying roller 33 repeats the above-described cycle by its own rotation. In this case, when the toner on the developing roller 32 is not used for the development but is contacted to the supplying roller 33 again, the toner once supplied to the developing roller 32 is removed and collected by the supplying roller 33. For that reason, the toner once incorporated in the supplying roller 33 is ensured as it is and then the toner newly incorporated in the supplying roller 33 at the absorbing portion is added as it is, so that when the rotation of the supplying roller 33 is continued, the amount of the toner in the supplying roller 33 is gradually increased until a state of the toner reaches a saturated state.

Further, a stirring member 34 is constituted by a stirring shaft 34*a* and a 100 μm-thick stirring sheet 34*b* of polyethylene terephthalate (PET). The stirring member 34 is rotated about the stirring shaft 34*a* in an arrow D direction in FIG. 2 to always stir the toner 31 during the drive of a main assembly of the image forming apparatus 1, thus preventing agglomeration of the particles of the toner 31.

<Print Mode>

Next, the plurality of print modes, in which the image forming apparatus 1 is operable, different in print speed (image forming speed) will be described. In the normal mode as the mode in which the print speed is fast, the above-described process speed is 50 mm/sec, and the normal mode is used when the image is printed (formed) on a normal recording material 15. Further, in this embodiment, the low-speed mode in which the print speed is slower than that in the normal mode is 25 mm/sec in process speed and is used in the case where the image is printed on special paper such as thick paper or glossy paper.

<Pre-Rotation>

The pre-rotation means is drive (rotation) performed, before an image forming operation in general, for a certain time (predetermined time) in order to satisfy a condition, necessary to perform the image forming operation, such as stabilization of an operation of the laser optical device 5 and ensuring of a time until a temperature of the fixing device 12 is increased. In this embodiment, as shown in (a) and (b) of FIG. 6, in the normal mode, a pre-rotation operation is performed for 15 seconds at the process speed of 50 mm/sec before the development. Further, in the low-speed mode, the pre-rotation operation is performed for 30 seconds at the process speed of 25 mm/sec before the development.

<Toner Content of Supplying Roller)

Figure 3:
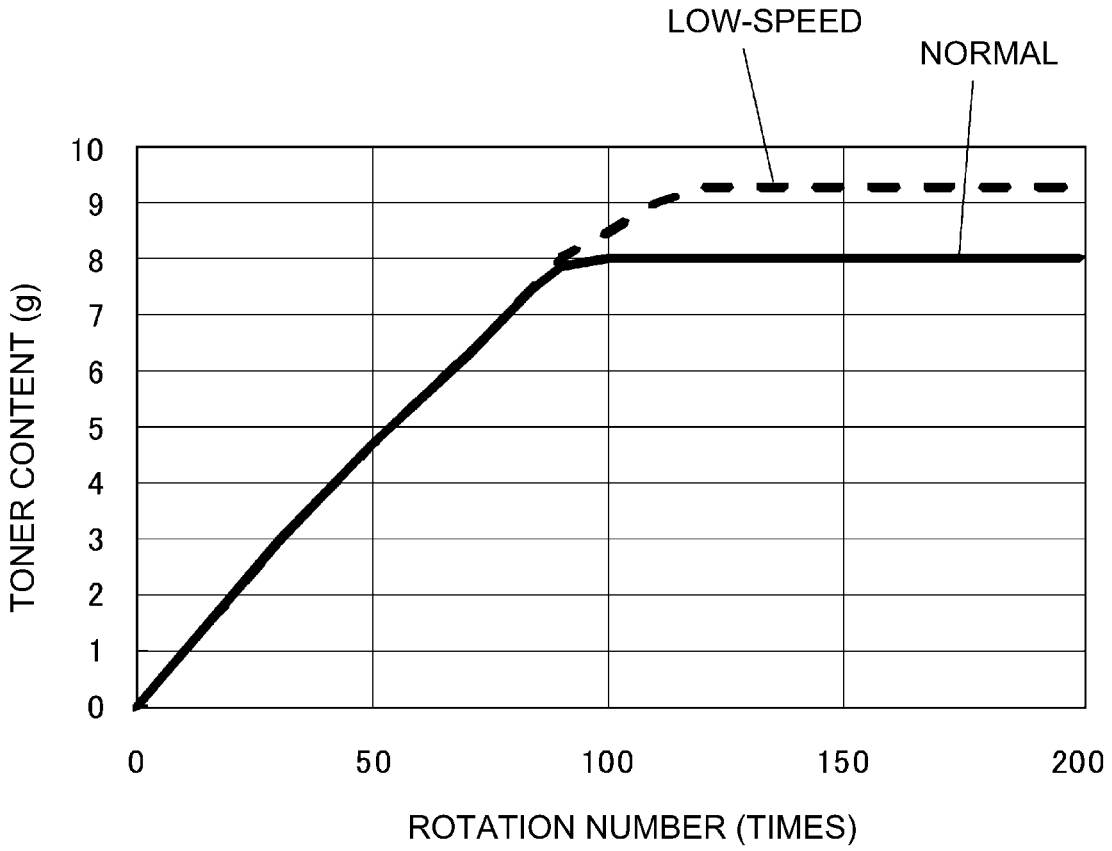
FIG. 3 is a graph showing a toner content of a developer feeding member with respect to the number of rotations of the developer feeding member during pre-rotation in a normal mode and a low-speed mode in the image forming apparatus according to the present invention in First Embodiment.

The amount of the toner incorporated in the supplying roller 33 in the operation in the normal mode and the amount of the toner incorporated in the supplying roller 33 in the operation in the low-speed mode will be described with reference to FIG. 3. In FIG. 3, the toner content of the supplying roller 33 with respect to the number of rotations of the supplying roller 33, from an initial state in which no toner is incorporated in the supplying roller when the developing roller 32 and the supplying roller 33 are rotated is shown.

As shown in FIG. 3, after the number of rotations of the supplying roller 33 reaches a predetermined number of rotations, the amount of the toner incorporated in the supplying roller 33 becomes constant, and the toner amount at this time is an amount of the toner, incorporated in the supplying roller 33, needed during the image forming operation. This toner amount is an amount determined by achieving a balance between an amount of the toner 31 incorporated and stored inside the sponge of the supplying roller 33 and an amount of the toner 31 discharged for being supplied to the developing roller 32.

It is understood that the constant toner content of the supplying roller 33 is, as shown in FIG. 3, different between the normal mode in which the print speed as the process speed is fast and the low-speed mode in which the print speed is slower than that in the normal mode. That is, it is understood that the amount of the toner incorporated in the supplying roller 33.

<During Switching from Normal Mode to Low-Speed Mode>

As described above, the amount of the toner incorporated in the supplying roller 33 is different depending on the process speed and therefore in the case where the print mode is switched from the normal mode to the low-speed mode, the toner amount in the supplying roller 33 is required to be increased. This is because when the process speed becomes slow, the supplying roller 33 is still capable of incorporating the toner 31 and therefore starts absorption of the toner 31. For that reason, the balance between the absorption of the toner 31 by the supplying roller 33 and the discharge of the toner 31 to the outside of the supplying roller 33 is destroyed, so that the discharged amount of the toner 31 becomes small and therefore the amount of the toner 31 supplied to the developing roller 32 becomes small.

For that reason, even when the amount of the toner 31 is sufficient, in the operation in the normal mode, the white dropout image is not generated in some deformation amount of the supplying roller 33 at the contact and deformation position. Even in such a case, when the print mode is switched from the normal mode to the low-speed mode, the white dropout image based on the contact and deformation position of the supplying roller 33 (hereinafter referred to as "white dropout image with supplying roller 33 period") is generated.

In the operation in the low-speed mode, the rotational drive of the supplying roller 33 is continued. As a result, as shown in (a) of FIG. 4, the amount of the toner 31 absorbed (incorporated) into the supplying roller 33 and the amount of the toner 31 discharged to the outside of the supplying roller 33 are finally balanced, so that the toner amount is stabilized at a certain toner content.

<Number of Rotations of Supplying Roller During Switch from Normal Mode to Low-Speed Mode>

From the above results, in this embodiment, at the time of switching the print mode from the normal mode to the low-speed mode, the number of rotations of the supplying roller 33 during pre-rotation is increased.

The reason why the white dropout image with supplying roller 33 period is generated in the case where the print mode is switched from the normal mode to the low-speed mode is, e.g., that the image forming operation is started with timing when the amount of the toner incorporated in the supplying roller 33 does not reach a desired amount. For that reason, by increasing the number of rotations of the supplying roller 33, compared with that in the normal mode, during pre-rotation before the image formation (before the development), the image forming operation can be started in the desired amount of the toner incorporated in the supplying roller 33.

In this case, a degree of the increase in number of rotations of the supplying roller 33 during the operation in the low-speed mode compared with the number of rotations of the supplying roller 33 during the operation in the normal mode will be described with reference to FIG. 5.

A toner content reaching point in the supplying roller 33 during the operation in the normal mode is $\alpha 1$, and a toner content reaching point in the supplying roller 33 during the operation in the low-speed mode is $\alpha 2$. Further, in this case, the numbers of rotates of the supplying roller 33 during the operations in the normal mode and the low-speed mode are $\beta 1$ and $\beta 2$, respectively. Further, e.g., in the case where the print mode is switched from the normal mode to the low-speed mode, a state changed from a point K to a point L shown in FIG. 5 is generated.

The state is changed from the point K to the point L in FIG. 5. In this case, a manner of changed in toner content when the toner content is changed from the toner content reaching point $\alpha 1$ to the toner content reaching point $\alpha 2$ is as follows. As shown by an increasing curve E1 of the toner content indicated by a broken line in FIG. 5, the toner content is increased along a curve drawn similarly as in the case of an increasing curve E2 of the toner content indicated by a solid line from the toner content reaching point $\alpha 1$ to the toner content reaching point $\alpha 2$. Thereafter, the toner content reaches the toner content reaching point $\alpha 2$.

For that reason, the number of rotations of the supplying roller 33 when the toner content reaches the toner content reaching point $\alpha 1$ in the operation in the low-speed mode is $\gamma 2$, the number of rotations of the supplying roller 33 when the toner content reaches the toner content reaching point $\alpha 2$ in the operation in the low-speed mode is $\beta 2$, and the number of rotations of the supplying roller 33 at the state change point K is $\gamma 2'$.

Then, the increase in toner content is shown by the increasing curve E1, of the toner content indicated by the broken line with the state change point K as a starting point, which corresponds to the increasing curve E2 which is indicated by the solid line from the toner content reaching point $\alpha 1$ to the toner content reaching point $\alpha 2$ and which is translated in rightward direction in FIG. 5. Further, the number of rotations of the supplying roller 33 necessary in the case where the print mode is switched from the normal mode to the low-speed mode is $(\beta 2-\gamma 2)=(\beta 2'-\gamma 2')$.

In (a) of FIG. 6, as the process speed used as the print speed in this embodiment, the process speeds in the operations in the normal mode and the low-speed mode are shown. Further, the rotational speeds of the supplying roller 33 in the operations in the normal mode and the low-speed mode and the content reaching points $\alpha 1$ and $\alpha 2$ of the toner 31 incorporated in the supplying roller 33 in the operations in the normal mode and the low-speed mode are shown. Further, the numerals of rotates $\beta 1$ and $\beta 2$ of the supplying roller 33 rotating until the contents of the toner 31 in the operations in the normal mode and the low-speed mode reach the reaching points $\alpha 1$ and $\alpha 2$, respectively, are shown. Further, the number of rotations $\gamma 2$ of the supplying roller 33 rotating until the content of the toner 31 in the operation in the low-speed mode reaches the reaching point $\alpha 1$ is shown.

The print mode is switched from the normal mode in which the print speed is fast to the low-speed mode in which the print speed is slower than that in the normal mode. In that case, the amount of the toner incorporated in the supplying roller 33 is, as shown in (a) of FIG. 6, required to be increased from 8 g to 9.3 g. For that reason, the necessary number of rotations of the supplying roller 33 in the operation in the low-speed mode is, as shown in (a) of FIG. 6, $(\beta 2-\gamma 2)=(40 \text{ turns}-10 \text{ turns})=30$ turns (times). For that reason, in this embodiment, in the case where the print mode is switched from the normal mode to the low-speed mode, a time T until the amount of the toner incorporated in the supplying roller 33 reaches a sufficient toner content is required to be $T=30 \text{ turns}\times(\pi\times 14 \text{ mm})/(32 \text{ mm/sec})=41.2$ sec, which is nearly equal to 41 sec.

Further, as shown in a low-speed mode (ii) in (b) of FIG. 6, a normal pre-rotation time in the operation in the low-speed mode in this embodiment is 30 sec. Therefore, a pre-rotation time extended by 11 sec obtained by subtracting the normal pre-rotation time of 30 sec from the above-described time T of 41 sec is needed.

<Verifying Experiment>

In the case where the print mode is switched from the normal mode to the low-speed mode, when the number of rotations of the supplying roller 33 during pre-rotation in the operation in the low-speed mode is increased, a degree of the white dropout image with supplying roller 33 period was checked. The check was made in a low-temperature and low-humidity environment (15° C., 10% RH) in which the degree of the white dropout image was liable to become worse. A durability test in which an image with a print ratio of 1% was formed on the recording material 15 in a two-sheet intermittent print manner in the operation in the normal mode was conducted, and the print mode is switched from the normal mode to the low-speed mode after sheet passing of 1000 sheets. During the operation in the low-speed mode, a solid black image for which the degree of the white dropout image with supplying roller 33 period becomes worse is formed in a single sheet, and the image at that time is checked.

A check criterion is such that the case where no white dropout image with supplying roller 33 period is generated is represented by "o", the case where the white dropout image with the supplying roller 33 period is generated only at a trailing end of the image is represented by "Δ", and the case where the white dropout image with supplying roller 33 period is generated from a central portion of the image is represented by "x". A result is shown in (b) of FIG. 6.

In (b) of FIG. 5, "NORMAL" shows the result in the operation in the normal mode before the switching to the low-speed mode. Further, "LOW-SPD(i)" shows the result in the operation in the low-speed mode in the case where the image formation started with the same predetermined number of the supplying roller 33 as that in the operation in the normal mode, and "LOW-SPD(ii)" shows the result in the operation in the low-speed mode in the case where the predetermined number of the supplying roller 33 is increased.

From the result shown in (b) of FIG. 6, the degree of the white dropout image with supplying roller 33 period in the operation in the low-speed mode was able to be improved by increasing the predetermined number of the supplying roller 33 in the operation in the low-speed mode in the case where the print mode was switched from the normal mode to the low-speed mode.

Second Embodiment

A constitution of the image forming apparatus according to the present invention in this embodiment will be described with reference to FIGS. 7 to 9. Constituent elements similar to those in First Embodiment are represented by the same reference numerals or symbols and will be omitted from description.

In First Embodiment described above, in the case where the print mode was switched from the normal mode to the low-speed mode, the constitution in which the number of rotations of the supplying roller 33 during pre-rotation in the operation in the low-speed mode was increased was employed.

However, the number of rotations of the supplying roller 33 during pre-rotation is required to be increased with a larger difference in process speed between the operations in the normal mode and the low-speed mode. Further, with a smaller difference in process speed between the operations in the normal mode and the low-speed mode, there is less need to increase the number of rotations of the supplying roller 33 during pre-rotation.

In this embodiment, the controller 16 effects the following control in the case where the print mode is switched from the normal mode in which the process speed is fast to the low-speed mode in which the process speed is slower than that in the normal mode. That is, the controller 16 effects control such that the number of rotations of the supplying roller 33 during pre-rotation is increased depending on the process speed difference which is a speed difference between the print speeds in the normal mode and the low-speed mode.

The image forming apparatus 1 in this embodiment is constituted similarly as in First Embodiment except for the process speed and the print modes. For that reason, in this embodiment, relations of print modes with process speeds and a constitution in which the number of rotations of the supplying roller 33 during pre-rotation is increased depending on the difference in process speed will be described.

1<Print Mode>

In this embodiment, as shown in (a) of FIG. 9, in an operation in a normal mode in which the print speed is first, the process speed (print speed) is 80 mm/sec. In an operation in a low-speed mode (1) in which the print speed is slower than that in the normal mode, the process speed (print speed) is 50 mm/sec. Further, in an operation in a low-speed mode (2) in which the print speed is slower than that in the low-speed mode (1), the process speed (print speed) is 25 mm/sec. Thus, three print modes are used.

<Toner Content of Supplying Roller 33>

States in which the toner is incorporated in the supplying roller 33 in the cases of the three print modes are shown in FIG. 7. In the case where the print mode is switched from the normal mode to each of the low-speed modes (1) and (2), a degree of increase in number of rotations of the supplying roller 33 during pre-rotation compared with the operation in the normal mode will be described with reference to FIG. 8. In FIG. 8, a toner content reaching point in the operation in the normal mode is a1, the toner content reaching point in the operation in the low-speed mode (1) is a2, and the toner content reaching point in the operation in the low-speed mode (2) is a3.

Further, when the amount of the toner incorporated in the supplying roller 33 reaches the toner content reaching points a1, a2 and a3, the numbers of rotations of the supplying roller 33 are b1, b2 and b3, respectively. As shown in FIG. 8, in the case where the print mode is switched from the normal mode to the low-speed mode (1), a manner of increase in toner content when the toner content is changed from a1 to a2 is, as described above in First Embodiment, similar to that in the case of rise from zero, so that the toner content reaches a2.

When the number of rotations of the supplying roller 33 at the time when the toner content reaches a1 in the operation in the low-speed mode (1) is c2, in the case where the print mode is switched from the normal mode to the low-speed mode (1), a necessary number of rotations of the supplying roller 33 to incorporate the toner sufficiently into the supplying roller 33 is (b2−c2).

Similarly, when the number of rotations of the supplying roller 33 at the time when the toner content reaches a2 in the operation in the low-speed mode (2) is c3, in the case where the print mode is switched from the normal mode to the low-speed mode (2), a necessary number of rotations of the supplying roller 33 to incorporate the toner sufficiently into the supplying roller 33 is (b3−c2).

Further, in the case where the print mode is switched from the low-speed mode (1) to the low-speed mode (2), a necessary number of rotations of the supplying roller 33 to incorporate the toner sufficiently into the supplying roller 33 is (b3−c3).

When the number of rotations of the supplying roller 33 for incorporating the toner sufficiently into the supplying roller 33 during pre-rotation is smaller than the number of rotations of the supplying roller 33 during pre-rotation in the operation in the normal mode, the number of rotations of the supplying roller 33 during pre-rotation in the operation in the low-speed mode may be the same as that in the normal mode and therefore is not required to be increased.

On the other hand, there is a case where the necessary number of rotations of the supplying roller 33 for incorporating the toner sufficiently into the supplying roller 33 during pre-rotation is larger than the number of rotations of the supplying roller 33 during pre-rotation in the operation in the normal mode. In that case, the number of rotations of the supplying roller 33 during pre-rotation is required to be increased in the operation in the low-speed mode to sufficiently incorporate the toner into the supplying roller 33.

As described above, the number of rotations of the supplying roller 33 during pre-rotation is determined depending on the speed difference between the operations in the print modes.

In (a) of FIG. 9, the process speeds, the rotational speeds of the supplying roller, the amounts of the toner incorporated in the supplying roller 33, the numbers of rotations of the supplying roller 33 when the toner content reaches certain toner contents during the operations in the normal mode, the low-speed mode (1) and the low-speed mode (2) are shown.

<Number of Rotations of Supplying Roller 33 at the Time of Mode Switching>

In this embodiment, a degree of increase in number of rotations of the supplying roller 33 at the time of the mode switching to each of the low-speed modes (1) and (2) will be described.

First, the case where the print mode is switched from the normal mode to the low-speed mode (1) will be considered. In this case, the amount of the toner incorporated in the supplying roller 33 is, as shown in (a) of FIG. 9, required to be increased from 7.5 g to 8 g. For that reason, the number of rotations of the supplying roller 33 necessary to increase the toner content from the state of the supplying roller 33 incorporating 7.5 g of the toner to 8 g is, as shown in (a) of FIG. 9, (b2−c2)=(21 turns−5 turns)=16 turns (times).

In this case, the time required for providing the toner content necessary and enough to effect image formation by using the supplying roller 33 in the operation in the low-speed mode (1) is 11 sec. A normal pre-rotation time in the operation in the low-speed mode (1) is 15 sec and therefore the toner content reaches the toner content necessary for the image formation within the normal pre-rotation time. For that reason, in the case where the print mode is switched from the normal mode to the low-speed mode (1), in this embodiment, there is no need to extend the pre-rotation time, so that the pre-rotation may only be required to be performed for the normal pre-rotation time.

Next, the case where the print mode is switched from the normal mode to the low-speed mode (2) will be considered. In this case, the amount of the toner incorporated in the supplying roller 33 is, as shown in (a) of FIG. 9, required to be increased from 7.5 g to 9.3 g. For that reason, the number of rotations of the supplying roller 33 necessary to increase the toner content from the state of the supplying roller 33 incorporating 7.5 g of the toner to 9.3 g is, as shown in (a) of FIG. 9, (b3−c2)=(40 turns'5 turns)=35 turns (times).

Here, as shown in FIG. 8, the number of rotations of the supplying roller 33 when the toner content in the operation in the low-speed mode (2) reaches a1 is the same as the number of rotations c2 of the supplying roller 33 when the toner content in the operation in the low-speed mode (1) reaches a1. This is because the rise from zero shown in FIG. 8 does not depend on the process speed but depends on the number of rotations of the supplying roller 33 and therefore the process speeds in the operations in any low-speed modes are the same.

In this case, the time required for providing the toner content necessary and enough to effect image formation by using the supplying roller 33 in the operation in the low-speed mode (2) is 48 sec. A normal pre-rotation time in the operation in the low-speed mode (2) is 30 sec and therefore in this case, where is a need to extend the pre-rotation time by 18 sec (=48 sec−30 sec).

Thus, the time required for providing the toner content necessary and enough to the image formation by using the supplying roller 33 in each of the operations in the respective low-speed modes depending on the process speed which is the print speed is set in advance and is stored in an unshown memory as a storing means. Further, a difference in time between the time and the normal pre-rotation time is stored as an extension time of the pre-rotation time. Then, the controller 16 effects control such that the number of rotations of the supplying roller 33 during pre-rotation is increased by extending the time by the extension time of the pre-rotation time depending on the speed difference between the process speeds as the print speeds.

<Verifying Experiment>

As shown in (b) of FIG. 9, in the case where the print mode is switched from the normal mode to each of the low-speed modes (1) and (2), when the pre-rotation time in each of the operations in the low-speed modes (1) and (2) is made longer than the normal pre-rotation time in the operation in the normal mode, a degree of the white dropout image with supplying roller 33 period was checked. As a comparative embodiment, in the case where the print mode is switched from the normal mode to the low-speed mode (2), the pre-rotation time was not extended. The check was made in a low-temperature and low-humidity environment (15° C., 10% RH) in which the degree of the white dropout image was liable to become worse. A durability test in which an image with a print ratio of 1% was formed on the recording material 15 in a two-sheet intermittent print manner in the operation in the normal mode was conducted, and the print mode is switched from the normal mode to each of the low-speed modes (1) and (2) after sheet passing of 1000 sheets. During the operation in the low-speed mode, a solid black image for which the degree of the white dropout image with supplying roller 33 period becomes worse is formed in a single sheet, and the image at that time is checked.

In this case, a check criterion is such that the case where no white dropout image with supplying roller 33 period is generated is represented by "o", the case where the white dropout image with the supplying roller 33 period is generated only at a trailing end of the image is represented by "Δ", and the case where the white dropout image with supplying roller 33 period is generated from a central portion of the image is represented by "x". A result is shown in (b) of FIG. 9.

From the above, depending on the process speed difference, the number of rotations of the supplying roller 33 during pre-rotation during the operation in the low-speed mode is increased. As a result, the image formation can be effected in a short time in the case where the process speed difference is small, and can be effected in a state in which the toner is sufficiently incorporated in the supplying roller 33 in the case where the process speed difference is large. Other constitutions are the same as those in First Embodiment, so that a similar effect can be obtained.

Third Embodiment

A constitution of the image forming apparatus according to the present invention in this embodiment will be described with reference to FIGS. 10 to 13. Constituent elements similar to those in First and Second Embodiments are represented by the same reference numerals or symbols and will be omitted from description.

In Second Embodiment described above, in the case where the process speed difference between the operations in the normal mode and the low-speed mode was large, the number of rotations of the supplying roller 33 was increased during pre-rotation in the operation in the low-speed mode to sufficiently incorporate the toner in the supplying roller 33 and then the image forming operation was started. However, when the number of rotations of the supplying roller 33 during pre-rotation is increased during the operation in the low-speed mode, there arises a problem such that it takes excessive time to perform the pre-rotation operation in the case where the print mode is switched from the normal mode to the low-speed mode.

In Second Embodiment, in the case where the print mode is changed from the normal mode to the low-speed mode (2), the pre-rotation time requires 48 sec, and in addition, because of the mode switching from the normal mode to the low-speed mode, a user feels very slow.

In this embodiment, in addition to the constitution in Second Embodiment, there is a case where the process speed difference between the operations in the normal mode and the low-speed mode and therefore the number of rotations of the supplying roller 33 during pre-rotation is required to be increased. In that case, the pre-rotation is once performed in the operation in a print mode in which the process speed between the process speeds in the operations in the normal mode and the low-speed mode, and then the print mode is switched from the print mode to a desired low-speed mode, so that the pre-rotation time is shortened.

In this embodiment, the same image forming apparatus 1 as those in First and Second Embodiments is used, and therefore a constitution in which the pre-rotation is once performed in the operation in the print mode between the normal mode and the low-speed mode to make the pre-rotation time shorter than a time required to perform all of the pre-rotations in the operation in the low-speed mode will be described.

<Print Mode>

In this embodiment, as described above with reference to (a) of FIG. 9, in an operation in a normal mode in which the print speed is first, the process speed (print speed) is 80 mm/sec. In an operation in a low-speed mode (1) in which the print speed is slower than that in the normal mode, the process speed (print speed) is 50 mm/sec. Further, in an operation in a low-speed mode (2) in which the print speed is slower than that in the low-speed mode (1), the process speed (print speed) is 25 mm/sec. Thus, three print modes are used.

<Operation at the Time of Mode Switching>

An actual operation in this embodiment will be described with reference to FIG. 10. As shown in FIG. 10, the case where first, the print operation is performed in the normal mode and then the print mode is switched from the normal mode to the low-speed mode (2) (mode switching indicated by G in FIG. 10) will be assumed. In this case, as described above in Second Embodiment, there is a need to increase the number of rotations of the supplying roller 33 during pre-rotation. For that reason, the pre-rotation time during the operation in the low-speed mode (2) becomes longer than that during the operation in the normal mode.

For that reason, in addition to the slow process speed, the number of rotations of the supplying roller 33 is increased and therefore the user feels that the pre-rotation time during the operation in the low-speed mode (2) is long.

For that reason, in the case where the print mode is switched from the normal mode to the low-speed mode (2), first, the pre-rotation is once performed at the process speed in the operation in the low-speed mode (1) in which the print speed is faster than that in the operation in the low-speed mode (2). Thereafter, the print mode is switched to the low-speed mode (2) and the pre-rotation is performed, and then the image forming operation is finally started (mode switching indicated by H in FIG. 10).

That is, in this embodiment, the controller 16 swatches the print mode from the normal mode in which the print speed is fast to the low-speed mode (2) in which the print speed is slower than that in the normal mode. In that case, the operation goes by way of the low-speed mode (1) in which the print speed (process speed of 50 mm/sec) is between the print speed (process speed of 80 mm/sec) in the normal mode and the print speed (process speed of 25 mm/sec) in the low-speed mode (2). The controller 16 stepwisely controls the rotation of the supplying roller 33 during pre-rotation.

The mode switch timing from the low-speed mode (1) to the low-speed mode (2) can be appropriately set in the following manner. For example, on the basis of the necessary number of rotations of the supplying roller 33 necessary and enough to form the image in the operation in the low-speed mode (2), the switching time between the operations in the low-speed modes (1) and (2) can be appropriately set depending on a process speed ratio between the operations in the low-speed modes (1) and (2).

Particularly, as shown in FIG. 11, only when the operation is in a state I in which the increasing speed of the toner content with respect to the number of rotations of the supplying roller 33 is the same irrespective of the fast and slow process speeds, the pre-rotation time can be most shortened in the case where the supplying roller 33 is rotated in the operation in the low-speed mode (1).

In the case where the pre-rotation is performed one time by way of the low-speed mode (1), the number of rotations of the supplying roller 33 in the operation in the low-speed mode (1) will be described with reference to FIGS. 11 and 12. As shown in a curve for the normal mode in FIG. 11, the increasing speed of the toner content with respect to the number of rotations of the supplying roller 33 (i.e., an inclination angle of the curve in FIG. 11) is divided into three states I, II and III shown in FIG. 11.

Each of the increasing states I, II and III of the toner content will be described. The state I shows the case where the number of rotations of the supplying roller 33 is small. As described above, the toner content increasing speed does not depend on the process speed but depends on only the number of rotations of the supplying roller 33. For that reason, in the case of the state I, in any mode, the toner content increasing speed with respect to the number of rotations of the supplying roller 33 is the same.

In the state II, the number of rotations of the supplying roller 33 is increased, so that compared with the state I, the toner content increasing speed with respect to the number of rotations of the supplying roller 33 becomes slow (i.e., the inclination angle of the curve in FIG. 11 becomes moderate). This is because the toner content is before it reaches the toner content depending on the process speed and therefore the toner is not readily incorporated into the supplying roller 33.

In the state III, the toner content increasing speed with respect to the number of rotations of the supplying roller 33 becomes zero (i.e., the inclination angle of the curve in FIG. 11 becomes zero (horizontal)). The state III is a state in which the discharge of the toner from the supplying roller 33 to the outside and the absorption (incorporation) of the toner into the supplying roller 33 are balanced and thus the toner content becomes a certain value depending on each of the process speeds.

When the above-described states I, II and III are considered, in order to shorten the pre-rotation time by forming the pre-rotation one time in the operation in the low-speed mode (1), only when the operation is in the state I, it is possible to most shorten the pre-rotation time in the case where the supplying roller 33 is rotated in the operation in the low-speed mode (1).

For that reason, in FIG. 12, only in a period of the state I in FIG. 11 in which the toner content increasing speed with respect to the number of rotations of the supplying roller 33 does not depend on the operations in the print modes, the pre-rotation is performed in the operation in the low-speed mode (1).

That is, a limit number of rotations of the supplying roller 33 in which the toner content increasing speed with respect to the number of rotations of the supplying roller 33 in the operation in the low-speed mode (1) can progress at the same increasing speed as that in the operation in the low-speed mode (2) is taken as d2. Up to the limit number of rotations d2, the toner content increasing speed with respect to the number of rotations of the supplying roller 33 is not changed between the operations in the low-speed modes (1) and (2). Therefore, the pre-rotation is performed in the operation in the low-speed mode (1) by the number of rotations of (d2−c2).

Next, this embodiment will be specifically described. As shown in (a) of FIG. 13, in the case where the print mode was switched from the normal mode to the low-speed mode (2), the supplying roller 33 was required to be rotated 35 times (turns) in order to incorporate the toner into the supplying roller 33 sufficiently. For that reason, as described above, the supplying roller 33 is rotated in the operation in the low-speed mode (1) only by (d2−c2)=(8 turns−5 turns)=3 turns and then is rotated in the operation in the low-speed mode (2) by a remaining number of rotations, i.e., 32 turns (=35 turns−3 turns). In this case, the necessary pre-rotation time is {3 turns×(π×14 mm)/(64 mm/sec)}+{32 turns×(π×14 mm)/(32 mm/sec)}=46 sec as shown in (b) of FIG. 13.

From the above, the pre-rotation time in the case where the print mode is switched from the normal mode to the low-speed mode (2) is 48 sec in Second Embodiment, but in this embodiment, the pre-rotation time can be shortened compared with the case of Second Embodiment by 2 sec (=48 sec−46 sec).

<Verifying Experiment>

As shown in (b) of FIG. 13, when the print mode is switched from the normal mode to the low-speed mode (2), the pre-rotation is once performed in the operation in the low-speed mode (1) and then the print mode is switched to the low-speed mode (2) to effect image formation. In that case, how a relationship between a degree of the white dropout image with supplying roller 33 period and the pre-rotation time changed was checked. As a comparative embodiment, also the case where the print mode was directly switched from the normal mode to the low-speed mode (2) without performing the pre-rotation in the operation in the low-speed mode (1) was checked. The check was made in a low-temperature and low-humidity environment (15° C., 10% RH) in which the degree of the white dropout image was liable to become worse. A durability test in which an image with a print ratio of 1% was formed on the recording material 15 in a two-sheet intermittent print manner in the operation in the normal mode was conducted, and the print mode is switched from the normal mode to each of the low-speed modes (1) and (2) after sheet passing of 1000 sheets. During the operation in the low-speed mode (2), a solid black image for which the degree of the white dropout image with supplying roller 33 period becomes worse is formed in a single sheet, and the image at that time is checked.

In this case, a check criterion is such that the case where no white dropout image with supplying roller 33 period is generated is represented by "o", the case where the white dropout image with the supplying roller 33 period is generated only at a trailing end of the image is represented by "Δ", and the case where the white dropout image with supplying roller 33 period is generated from a central portion of the image is represented by "x". A result is shown in (b) of FIG. 13.

From the above result, also in the case where the print mode is switched from the low-speed mode (2) once via the low-speed mode (1), it becomes possible to shorten the pre-rotation time without generating the white dropout image with supplying roller 33 period.

In this embodiment, the case where the three print modes are employed is described, but the present invention is not limited thereto. The present invention is applicable to also the case where another plurality of print modes are employed. Further, when there is no constraint of the image forming apparatus, it becomes possible to shorten the pre-rotation time by continuously reducing the print speed. Other constitutions are the same as those in the above-described embodiments, and a similar effect can be obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 261209/2011 filed Nov. 30, 2011, which is hereby incorporated by reference.

What is claimed is:

1. An image forming apparatus configured to form an image, comprising:

an image bearing member on which an electrostatic latent image is to be formed;

a developer carrying member for carrying a developer to visualize the electrostatic latent image;

a developer feeding member, having a foam layer at its surface, for feeding the developer to said developer carrying member by being rotated in contact with said developer carrying member; and a controller configured to execute an operation in a first mode in which the electrostatic latent image is visualized by said developer carrying member while rotating said developer feeding member at a first rotational speed and an operation in a second mode in which the electrostatic latent image is visualized by said developer carrying member while rotating said developer feeding member at a second rotational speed slower than the first rotational speed, and wherein said controller executes a preparatory operation, after the operation in the first mode and before the operation in the second mode, for increasing an amount of the developer contained in said developer feeding member by rotating said developer feeding member, and in the preparatory operation, said developer feeding member is rotated a plurality of times at a third rotational speed faster than the second rotational speed and slower than the first rotational speed and then is rotated a plurality of times at the second rotational speed.

2. An image forming apparatus according to claim 1, wherein when the number of rotations of said developer feeding member at the third rotational speed in the preparatory operation is A and the number of rotations of said developer feeding member at the second rotational speed in the preparatory operation is B, A and B satisfy the following relationship:

$$1<A<B.$$

3. An image forming apparatus according to claim 1, wherein the number of rotations of said developer feeding member in the preparatory operation is increased with an increase in difference between the first rotational speed and the second rotational speed.

4. An image forming apparatus according to claim 1, wherein a speed at which the electrostatic image is visualized in the operation in the second mode is slower than a speed at which the electrostatic image is visualized in the operation in the first mode.

* * * * *